United States Patent [19]

Bhattacharya et al.

[11] 4,255,187

[45] Mar. 10, 1981

[54] BISMUTH-CONTAINING STEEL

[75] Inventors: Debanshu Bhattacharya, Matteson, Ill.; Dennis T. Quinto, St. John; Michael O. Holowaty, Crown Point, both of Ind.

[73] Assignee: Inland Steel Company, Chicago, Ill.

[21] Appl. No.: 70,669

[22] Filed: Aug. 29, 1979

Related U.S. Application Data

[63] Continuation-in-part of Ser. No. 5,965, Jan. 24, 1979.

[51] Int. Cl.[3] ..... C22C 38/60

[52] U.S. Cl. ..... 75/123 AA; 75/123 R; 75/123 A; 75/123 G; 75/123 N; 75/129; 148/2; 148/12 R

[58] Field of Search ..... 75/123 R, 123 A, 123 AA, 75/123 FG, 123 N, 129; 148/2, 12

[56] References Cited

U.S. PATENT DOCUMENTS

| | | | |
|---|---|---|---|
| 2,378,548 | 6/1945 | Gregg et al. | 75/123 A |
| 2,978,320 | 4/1961 | Larson et al. | 75/123 AA |
| 3,152,889 | 10/1964 | Holowaty | 75/123 AA |
| 3,152,890 | 10/1964 | Holowaty | 75/123 AA |
| 3,634,074 | 1/1972 | Ito et al. | 75/123 AA X |
| 3,679,400 | 7/1972 | Nachtman | 75/123 AA |
| 3,723,103 | 3/1973 | Kato et al. | 75/123 AA X |
| 3,973,950 | 8/1976 | Itoh et al. | 75/123 A X |
| 4,004,922 | 1/1977 | Thivellier et al. | 75/123 AA |

FOREIGN PATENT DOCUMENTS

| | | | |
|---|---|---|---|
| 47-206 | 11/1972 | Japan | 75/123 AA |
| 1020535 | 2/1966 | United Kingdom | 75/123 AA |

*Primary Examiner*—L. Dewayne Rutledge
*Assistant Examiner*—W. G. Saba
*Attorney, Agent, or Firm*—Merriam, Marshall & Bicknell

[57] ABSTRACT

A free machining cast steel shape containing bismuth which functions as a liquid metal embrittler. The ability of the bismuth to function as a liquid metal embrittler is enhanced by restricting the total amount of ingredients which lower the wetting ability of the bismuth to less than the bismuth content and by controlling the amount of strengthening elements added to the steel.

5 Claims, No Drawings

BISMUTH-CONTAINING STEEL

RELATED APPLICATION

This is a continuation-in-part of application Ser. No. 5965 filed Jan. 24, 1979 and entitled "Semi-Finished Steel Article and Method For Producing Same."

BACKGROUND OF THE INVENTION

The present invention relates generally to free machining steels containing bismuth and more particularly to a bismuth-containing cast steel shape in which the ability of the bismuth to function as a liquid metal embrittler is enhanced.

In the machining of steel, a cutting tool is applied to the surface of the steel, and either the steel or the tool is moved relative to the other to effect a cutting of the steel by the tool. This forms chips of steel which are removed from the steel during the machining operation. Chip formation is related to the formation and propagation of microcracks in the steel.

More specifically, during machining, a force is applied to the steel at the location where the cutting edge of the tool contacts the steel and this force causes microcracks to form in the steel. These microcracks may originate at inclusions in the steel, or these microcracks may extend into the steel from the location where the steel is contacted by the cutting edge of the tool to an inner-most tip of the microcrack. These microcracks generally proceed along grain boundaries or interphase boundaries in the steel. To propagate these microcracks requires the expenditure of energy during the machining operation. The smaller the expenditure of energy required to propagate the microcrack, the easier it is to machine the steel and, therefore, the better the machinability of the steel.

During machining, the temperature of the steel in the vicinity of a microcrack is raised by the heat generated in the machining operation. The temperature increase of the steel, due to the machining operation, is highest at the cutting edge of the machining tool and decreases as the distance from the cutting edge increases.

if a liquid metal embrittler is present at or in the vicinity of the innermost tip of a microcrack, the energy required to propagate the microcrack is lowered. A liquid metal embrittler is a metal or alloy which has a relatively low melting point, so that it is liquid at the temperature prevailing at the tip of the microcrack during machining, and which also has a relatively low surface-free energy value near its melting point so as to impart to the liquid metal embrittler the ability to wet a relatively large surface area along grain boundaries or interphase boundaries. The lower the surface free energy value (or surface tension), the greater the surface area coverage of the liquid metal embrittler. Normally, the surface free energy value of a liquid metal embrittler rapidly decreases (and thus its wetting ability rapidly increases) at the melting point of the liquid metal embrittler.

When a microcrack is initially propagated in the vicinity of an inclusion containing a liquid metal embrittler, and the temperature at the location of that inclusion has been raised sufficiently to liquify the liquid metal embrittler, there is an almost immediate transport of liquid metal embrittler to the tip of the microcrack. This transport proceeds along grain boundaries, phase boundaries or the like. The liquid metal embrittler thus transported may be a layer only a few atoms thick, but that is enough to perform its intended function as a liquid metal embrittler at the microcrack.

The lower the melting point of the liquid metal embrittler and the stronger its tendency to wet the steel grain boundaries or interphase boundaries, the farther away from the tool cutting edge are regions of the steel embrittled for easier fracture.

Because the ability of a liquid metal embrittler to perform its intended function depends upon its having a relatively low surface free energy value at its melting point, anything which raises the surface free energy value of the liquid metal embrittler is undesirable and anything which lowers its surface free energy value is desirable.

It has been conventional to add sulfur to steel to improve machinability. Sulfur combines with manganese to form manganese sulfide inclusions in the steel. The manganese content is typically about two and one-half times the sulfur content of the steel to assure that the sulfur combines with the manganese rather than iron thereby avoiding a hot rolling defect known as hot shortness. Manganese can strengthen the steel by a mechanism known as solid solution strengthening. The manganese which combines with the sulfur is not available to strengthen the steel.

SUMMARY OF THE INVENTION

Bismuth has a relatively low melting point (271° C. or 520° F.), and the surface free energy value for bismuth at a temperature near its melting point is relatively low (375 ergs/cm$^2$). As a result, absent any interference with these properties, bismuth has a strong tendency to wet steel grain boundaries or interphase boundaries at a distance relatively far away from the cutting edge of the machining tool, thereby embrittling those regions for easy fracture.

The surface free energy value of bismuth at its melting point is increased, and hence the ability of bismuth to wet grain boundaries or interphase boundaries is decreased, by certain elements, most of which are normally present as impurities in steel. These elements comprise copper, nickel, tin and zinc. Copper, nickel and tin are normally present as impurities in steel in amounts up to about 0.1 wt.% each, for example, but zinc is normally not found in steel. Copper, nickel and tin, are normally tolerated in steel in the amounts given above.

However, because these elements interfere with the wetting ability of bismuth, amounts thereof which might be tolerable in ordinary steel are not tolerable in a bismuth-containing steel in accordance with the present invention. In the instant steel, the bismuth content is in the range 0.05–0.40 wt.%, and the total amount of ingredients which lower the wetting ability of the bismuth is less than the bismuth content of the steel.

The addition of tellurium to a bismuth-containing steel lowers the surface free energy value of the bismuth and therefore enhances its wetting ability. Accordingly, to the extent that the wetting ability of the bismuth is diminished by the presence of copper, nickel, tin and the like, this diminution can be at least partially offset by the addition of tellurium in amounts up to 0.06 wt.%, preferably at least 0.015 wt.%.

A liquid metal embrittler is more effective in a stronger steel. Therefore, a steel in accordance with the present invention has a carbon content of at least 0.06 wt.% up to about 1.0 wt.% and a manganese content preferably greater than three times the sulfur content and which is at least 0.30 wt.%.

The steel may be cast into an ingot shape or into a billet shape (e.g., by continuous casting). When cast into an ingot, the steel shape may be hot rolled into a billet. The billets may be further reduced by hot rolling, and the resulting hot rolled product may be cold drawn into bars. The properties imparted to the cast steel shape by the present invention will be carried forward to subsequent stages of reduction. Accordingly, as used herein, the term "cast steel shape" includes both the original shape, before reduction, and the reduced shape.

Other features and advantages are inherent in the product claimed and disclosed or will become apparent to those skilled in the art from the following detailed description.

DETAILED DESCRIPTION

A free machining cast steel shape in accordance with the present invention has a steel composition within the following range, in wt.%:

| | |
|---|---|
| carbon | 0.06–1.0 |
| manganese | 0.3–1.6 |
| silicon | 0.30 max. |
| sulfur | 0.03–0.50 |
| phosphorous | 0.12 max. |
| bismuth | 0.05–0.40 |
| iron | essentially the balance |

The phrase "essentially the balance," as applied to iron, allows for the inclusion of those impurities usually found in steel except for those ingredients which lower the wetting ability of bismuth. With respect to such ingredients, the total amount thereof should be less than the bismuth content of the steel. The ingredients which lower the wetting ability of bismuth are copper, tin, zinc and nickel. Preferably, the total amount of these ingredients should be less than sixty percent of the bismuth content of the steel. Typically, the bismuth content of the steel is no greater than about 0.20 wt.%.

Tellurium enhances the wetting ability of bismuth, and, in one embodiment, tellurium may be included in the steel in an amount up to 0.06 wt.%, there being preferably at least 0.015 wt.% tellurium in the steel. Lead may also be added to the steel, to improve the machinability of the steel, in an amount up to 0.3 wt.%.

Copper, nickel and tin are normally found in steel when scrap steel is used as one of the raw materials from which the steel is produced. It is not commercially practical to remove copper, tin or nickel during the steel-making operation. Accordingly, in order to assure that copper, nickel and tin are limited to a total amount less than the bismuth content of the steel, in accordance with the present invention, it is necessary to either avoid introducing copper, nickel or tin-bearing scrap during the steel making operation or to segregate the copper, nickel or tin-bearing scrap from the rest of the steel scrap prior to the steel making operation. These precautions, however, need not be taken with respect to zinc-bearing scrap because zinc boils out of the steel at the temperature of molten steel so that zinc is automatically eliminated during the steel-making operation. The steel may also be made entirely from hot metal produced at a blast furnace, dispensing completely with the use of any scrap, but this type of restriction on raw materials is not particularly desirable from a commercial standpoint.

Examples of bismuth-containing steel in accordance with the present invention are set forth in Table I below.

TABLE I

| | WT. % | | | |
|---|---|---|---|---|
| Ingredients | A | B | C | D |
| Carbon | 0.06–0.08 | 0.45–0.47 | 0.41–0.43 | 0.06–0.09 |
| Manganese | 0.60–0.80 | 1.52–1.60 | 1.45–1.55 | 1.05–1.10 |
| Silicon | 0.01–0.02 | 0.20–0.25 | 0.15–0.30 | 0.02 |
| Sulfur | 0.12–0.15 | 0.29–0.33 | 0.35 | 0.26–0.33 |
| Phosphorous | 0.06–0.07 | 0.03 | 0.03 | 0.06–0.09 |
| Bismuth | 0.3–0.4 | 0.27–0.33 | 0.2–0.3 | 0.1–0.2 |
| Copper | 0.05 | 0.08 | 0.08 | 0.01 |
| Tin | 0.02 | 0.04 | 0.01 | 0.008 |
| Nickel | 0.05 | 0.08 | 0.01 | 0.01 |
| Total Cu, Sn, Ni | 0.12 | 0.20 | 0.10 | 0.028 |

In all of the above steels, A–D, the balance of the composition consists essentially of iron (plus the usual impurities unless otherwise indicated).

As is reflected by Table I, above, the steel contains bismuth which functions as a liquid metal embrittler. In addition, certain other ingredients in the steel have been adjusted to enhance the ability of bismuth to function as a liquid metal embrittler. Thus, the total amount of ingredients which lower the wetting ability of bismuth (i.e., copper, tin, nickel) is less than the amount of bismuth in the steel. The carbon content is at least 0.06 wt.%, to provide strength to the steel. The manganese content is greater than three times the sulfur content (as well as greater than 0.30 wt.%) thus contributing to the strength of the steel by solid solution strengthening. As noted above, increasing the strength of the steel makes the liquid metal embrittler more effective.

As a variation of the embodiment reflected by the examples set forth in Table I, the steel may also include tellurium or tellurium and lead, examples thereof being set forth in Table II below.

TABLE II

| | WT. % | | | |
|---|---|---|---|---|
| Ingredients | E | F | G | H |
| Carbon | 0.07 | 0.46 | 0.42 | 0.08 |
| Manganese | 0.95 | 1.55 | 1.50 | 0.90 |
| Silicon | 0.01 | 0.22 | 0.18 | 0.02 |
| Sulfur | 0.14 | 0.30 | 0.35 | 0.27 |
| Phosphorous | 0.06 | 0.02 | 0.02 | 0.08 |
| Bismuth | 0.38 | 0.28 | 0.22 | 0.12 |
| Tellurium | 0.04 | 0.05 | 0.05 | 0.02 |
| Lead | — | — | 0.15 | 0.12 |
| Copper | 0.1 | 0.08 | 0.02 | 0.01 |
| Tin | 0.05 | .04 | 0.01 | 0.01 |
| Nickel | 0.1 | 0.08 | 0.02 | 0.005 |
| Total Cu, Sn, Ni | 0.25 | 0.20 | 0.05 | 0.025 |

In all of the above steels E–H, the balance of the composition consists essentially of iron (plus the usual impurities unless otherwise indicated).

Tellurium enchances the ability of bismuth to function as a liquid metal embrittler because tellurium lowers the surface free energy value of the bismuth at its melting point. This, in turn, increases the wetting ability of the bismuth which increases the area which the bismuth can wet when it acts as a liquid metal embrittler. Thus, tellurium can offset or compensate for any loss in wetting ability occasioned by the presence of even reduced amounts of copper, tin or nickel in the steel. Unlike tellurium, lead has relatively little effect on the surface free energy of the bismuth.

Typically, the bismuth is present as inclusions containing elemental bismuth. Where tellurium or tellurium and lead are present, the bismuth may be combined with one or both of these elements as an inter-metallic compound thereof, said inter-metallic compounds being present in the steel as inclusions.

The ability of bismuth to function as a liquid metal embrittler is directly related to the immediate transport thereof to the tip of the microcrack, so that anything which enhances the likelihood of immediate transport to the tip of a microcrack is desirable. If bismuth is provided in the microstructure of the steel as bismuth-containing inclusions having a mean inclusion size less than 5 microns, this increases the number of locations in the microstructure of the steel where bismuth is available for immediate transport to the tip of a microcrack during a machining operation, compared to a steel having the same amount of bismuth in inclusions of larger size.

In order to obtain bismuth-containing inclusions having a mean size less than five microns, the steel should be subjected to a relatively rapid solidification rate (e.g., an average of 20° C. or 36° F. per minute) upon casting into the desired shape which may be an ingot or a billet.

The desired solidificaton rate can be obtained in conventional processes in which steel is continuously cast into billets by appropriate cooling of the casting mold or by adjusting the rate at which the steel moves through the cooling zone and the like. More specifically, if the inclusions exceed the desired size, the cooling of the molds should be increased (e.g., by decreasing the temperature of the cooling fluid circulated through the molds or increasing its circulation rate), the rate at which the steel is moved through the cooling zone should be decreased, the temperature of the cooling sprays in the cooling zone should be decreased or the spray rate increased or a plurality of the above should be practiced. For a continuously cast billet having a cross-section of about 7" by 7", if the billet is fully solidified in about 9 to 11 minutes, the desired size of bismuth inclusions should be obtained.

The desired solidification rate can be obtained when the steel is cast into ingots by chilling the ingot molds or by taking other procedures which assure that the desired solidification rate would be obtained in the ingot mold. For example, the molten steel may be introduced into the ingot mold from a ladle at a lower temperature than is conventionally utilized (e.g., 2810° F. (1543° C.) versus 2833° F. (1556° C.) conventionally used). Care should be taken, to avoid lowering the temperature too much or the steel may freeze in the ladle near the end of the ingot casting operation.

The bismuth may be added in the form of shot having a size finer than 40 mesh. Alternatively, the bismuth may be added as needles approximately five millimeters long by two millimeters in diameter. Typically, the needles are contained in five pound bags which are added to the molten steel during the casting operation.

In a continuous casting operation, the bismuth is added, preferably as shot, to the tundish of the continuous casting apparatus or to the ladle from which the steel is poured into the tundish or to the pouring stream of molten steel entering the casting mold.

In ingot casting, the bismuth is added to the molten steel when the ingot mold is between $\frac{1}{8}$ and $\frac{7}{8}$ full (ingot height). In one embodiment, the bismuth is added to the stream of molten steel entering the ingot mold at a location on the stream above the location of impact of the stream in the partially filled ingot mold. In another embodiment, the bismuth is added at substantially the location of impact, in the partially filled ingot mold, of the molten metal stream. When the bismuth is added at the impact location, it may be in the form of either loose shot or needles in five pound bags. When the bismuth is added to the pouring stream, at a location above the location of impact, the bismuth should be added as shot. When added as shot, use may be made of a conventional shot-adding gun, heretofore utilized for adding other ingredients (e.g., lead) in shot form to steel.

When bismuth shot is added to the molten steel stream entering the ingot mold, the location of this addition is typically from about six inches to about two feet above the top of the ingot mold. When bismuth shot is added to the molten steel stream entering the continuous casting mold, the location of this addition is typically about one to one and a half feet above the location of impact of the stream in the mold.

Another expedient for reducing the size of the bismuth inclusions to the desired size (less than 5 microns) is to subject the molten steel, during and after the addition of the bismuth, to stirring. This may be performed in either the ingot mold or the tundish in a continuous casting process and may be accomplished mechanically, electromagnetically, with convection currents or with currents caused by the presence in the molten steel of greater than 100 parts per million of oxygen which, during cooling of the molten steel, will attempt to escape from and create currents in the molten steel. All such stirring, whether produced mechanically, electromagnetically, by convection currents or by currents of the type described in the preceding sentence, improve the uniformity of the distribution of the bismuth inclusions as well as providing a reduction in inclusion size.

The foregoing detailed description has been given for clearness of understanding only, and no unnecessary limitations should be understood therefrom as modifications will be obvious to those skilled in the art.

We claim:

1. In a free machining cast steel shape consisting essentially of, in wt.%,

| | |
|---|---|
| carbon | 0.06 to 1.0 |
| manganese | 0.3–1.6 |
| silicon | 0.30 max. |
| sulfur | 0.03–0.50 |
| phosphorous | 0.12 max. |
| bismuth | 0.05–0.40 |
| iron | essentially the balance, |

the improvement wherein:

the total amount of ingredients which lower the wetting ability of bismuth is less than the bismuth content of said steel.

2. In a free machining cast steel shape as recited in claim 1 wherein:

said ingredients which lower the wetting ability of bismuth are copper, tin, zinc and nickel.

3. In a free machining cast steel shape as recited in claim 1 wherein said steel further comprises up to 0.3 wt.% lead and up to 0.06 wt.% tellurium.

4. In a free machining cast steel shape as recited in claim 1 wherein said steel includes at least 0.015 wt.% tellurium to enhance the wetting ability of said bismuth.

5. In a free machining cast steel shape as recited in claim 1 wherein the manganese content is greater than three times the sulfur content.

* * * * *